US008523619B2

(12) United States Patent
Itou et al.

(10) Patent No.: US 8,523,619 B2
(45) Date of Patent: Sep. 3, 2013

(54) TERMINAL FITTING

(75) Inventors: Tomonari Itou, Yokkaichi (JP); Tomoki Okano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 53 days.

(21) Appl. No.: 13/242,247

(22) Filed: Sep. 23, 2011

(65) Prior Publication Data

US 2012/0094550 A1 Apr. 19, 2012

(30) Foreign Application Priority Data

Oct. 19, 2010 (JP) ..... 2010-234232

(51) Int. Cl.
*H01R 11/22* (2006.01)

(52) U.S. Cl.
USPC ..... 439/852

(58) Field of Classification Search
USPC ..... 439/852, 843
See application file for complete search history.

(56) References Cited

U.S. PATENT DOCUMENTS

| | | | | |
|---|---|---|---|---|
| 6,171,155 | B1 * | 1/2001 | Miwa et al. | 439/852 |
| 7,156,704 | B2 | 1/2007 | Shimizu | |
| 2009/0253314 | A1 | 10/2009 | Shimizu | |

FOREIGN PATENT DOCUMENTS

| | | |
|---|---|---|
| DE | 29514010 | 11/1995 |
| JP | 2006100233 | 4/2006 |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A terminal fitting (10) is provided with a box-shaped main portion (11) capable of receiving a tab (61) of a mating terminal fitting (60) and a resiliently deformable resilient contact piece (12) arranged in the main portion (11) to be connected to the tab (61) inserted into the main portion (11). The resilient contact piece (12) includes a supporting portion (40) for resilient deformation in the main portion (11). The main portion (11) includes a base portion (18) facing the resilient contact piece (12) in a resilient deforming direction of the resilient contact piece (12). The base portion (18) includes a recess (46) formed within the thickness range thereof the base portion (18), and the supporting portion (40) is in contact with the bottom surface of the recess (46).

19 Claims, 7 Drawing Sheets

TERMINAL FITTING

BACKGROUND OF THE INVENTION

1. Field of the Invention

The invention relates to a terminal fitting.

2. Description of the Related Art

U.S. Pat. No. 7,156,704 discloses a terminal fitting with a box-shaped main portion capable of receiving a tab of a mating terminal fitting. A resiliently deformable resilient contact piece is arranged in the main portion and can be connected to the tab inserted into the main portion. The main portion includes a base that faces the resilient contact piece in a resilient deforming direction of the resilient contact piece. The base has substantially the same thickness in a length direction except at a through hole formed in a front end portion thereof. The resilient contact piece is cantilevered obliquely up toward the front from the rear end thereof and is bent to form a substantially U-shaped support that is in contact with the upper surface of the base. The tab inserted into the main portion, contacts the resilient contact piece and causes the resilient contact piece to deform resiliently toward the base with the support as a supporting point.

The support and the base of the above-described terminal fitting are juxtaposed in a height direction which is the resilient deforming direction of the resilient contact piece, and the thicknesses of both portions are added to the height of the main portion. Accordingly, it is difficult to reduce the height of the main portion. On the other hand, the height of the main portion can be reduced if the height of the resilient contact piece is reduced. However, this may lead to a situation where there is an insufficient deformation space for the resilient contact piece.

The invention was developed in view of the above situation and an object thereof is to enable a miniaturization of a terminal fitting while ensuring a deformation space for a resilient contact piece.

SUMMARY OF THE INVENTION

The invention relates to a terminal fitting made of an electrically conductive plate material. The terminal fitting has a substantially box-shaped tubular main portion that can receive a tab of a mating terminal fitting. A resiliently deformable resilient contact is arranged in the main portion and can be connected to the tab inserted into the main portion. The resilient contact has a support that functions as a support for resilient deformation. The main portion includes a base facing the resilient contact piece in a deforming direction of the resilient contact. A recess is formed within the thickness range of the base and the support is in contact with the bottom surface of the recess. As a result, a dimension of the main portion is reduced by the depth of the recess while a deformation space for the resilient contact is ensured. Therefore, the terminal fitting can be miniaturized while maintaining a deformation space for the resilient contact.

The support preferably is in contact with the bottom surface of the recess while being pre-loaded. Thus, a contact state of the support and the base is maintained firmly.

The resilient contact piece preferably includes a straight portion extending substantially straight from a back end of the main portion to the support along the base. Thus, the resilient contact can be formed easily without needing to bend this part.

The resilient contact piece preferably comprises a straight portion extending substantially horizontally forward from the main portion, a support connected to the front end of the straight portion and a resilient main body extending obliquely in toward the front from the support and inclined somewhat down toward the front at its front end portion.

The recess preferably extends from a position substantially corresponding to an intermediate portion of the resilient main body to a position substantially corresponding to a rear end of the straight portion in forward and backward directions and in a range substantially over an entire width of a base of the main portion in the width direction.

The base of the main portion preferably is formed with a through hole or recess at a position substantially facing a free end of the resilient main body.

A retraction groove preferably is formed in an inner surface of the base and communicates with the through hole. Thus, the front end of the resilient main body can enter the retraction groove when the resilient contact piece is deformed excessively.

The depth of the retraction groove preferably increases gradually toward the through hole.

The resilient main body and the straight portion preferably are separated from the bottom surface of the recess.

A depth of the recess preferably is substantially equal to a projecting distance of the support.

The main portion preferably comprises a ceiling with a first ceiling plate connected to one side of the main portion and a second ceiling plate connected to another side of the main portion.

The first ceiling plate may comprise a front first ceiling plate located toward a front end and a rear first ceiling plate located toward a rear end. The second ceiling plate comprises a front second ceiling plate located toward a front end and a rear second ceiling plate located toward a rear end. The front second ceiling plate preferably is bent to project in, thereby forming a receiving portion.

The rear second ceiling plate preferably comprises a coupling connected to another side portion and an extending portion connected to the rear edge of a ceiling plate. The coupling preferably is arranged before the rear first ceiling plate. The coupling preferably is formed with at least one projection right before the rear first ceiling plate.

These and other objects, features and advantages of the invention will become more apparent upon reading the following detailed description of preferred embodiments and accompanying drawings.

DETAILED DESCRIPTION OF THE PREFERRED EMBODIMENTS

A terminal fitting 10 according to the invention is identified by the numeral 10 in FIGS. 1 to 7. The terminal fitting 10 is formed integrally or unitarily by applying a bending, folding and/or embossing process and the like to an electrically conductive metal plate material punched or cut out into a development shape shown in FIG. 7. The terminal fitting 10 is connectable to a mating terminal fitting 60.

Figure 4:
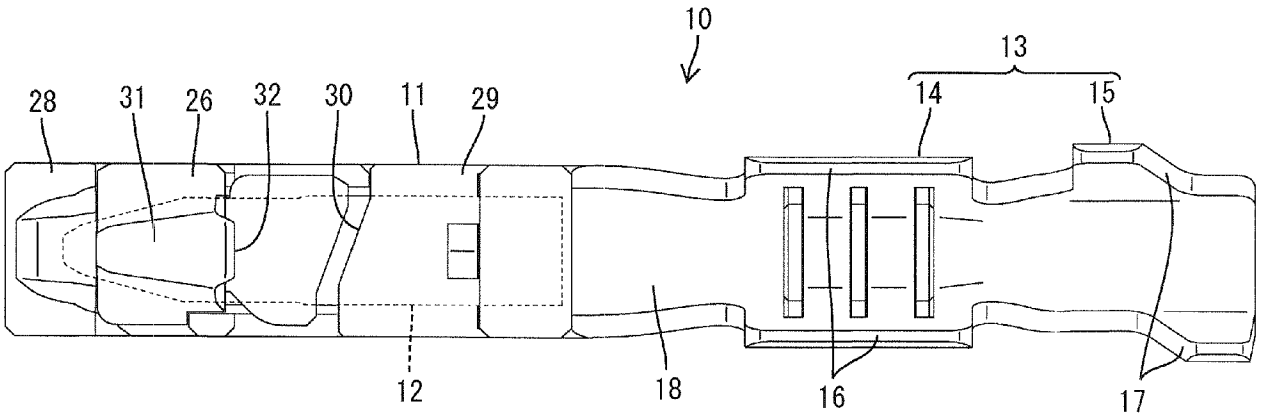
FIG. 4 is a plan view of the terminal fitting.
Figure 5:
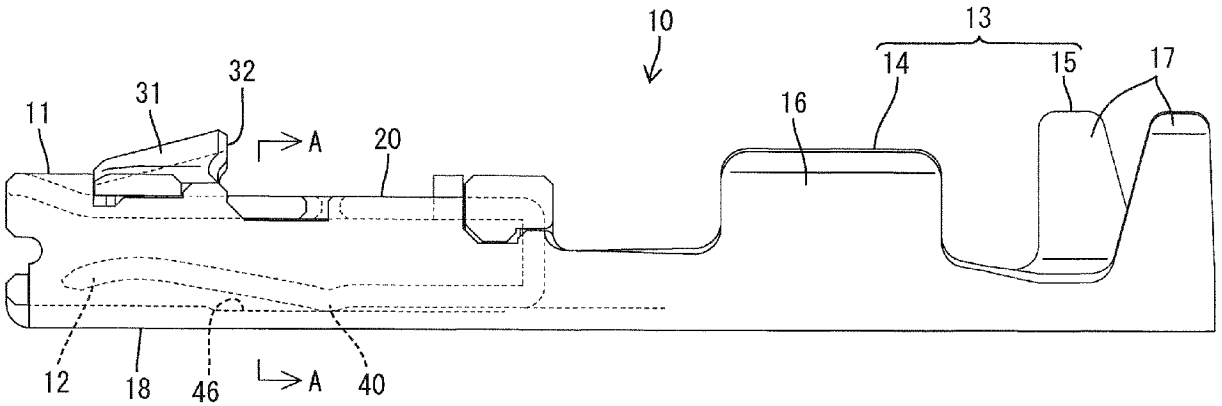
FIG. 5 is a side view of the terminal fitting.
Figure 6:
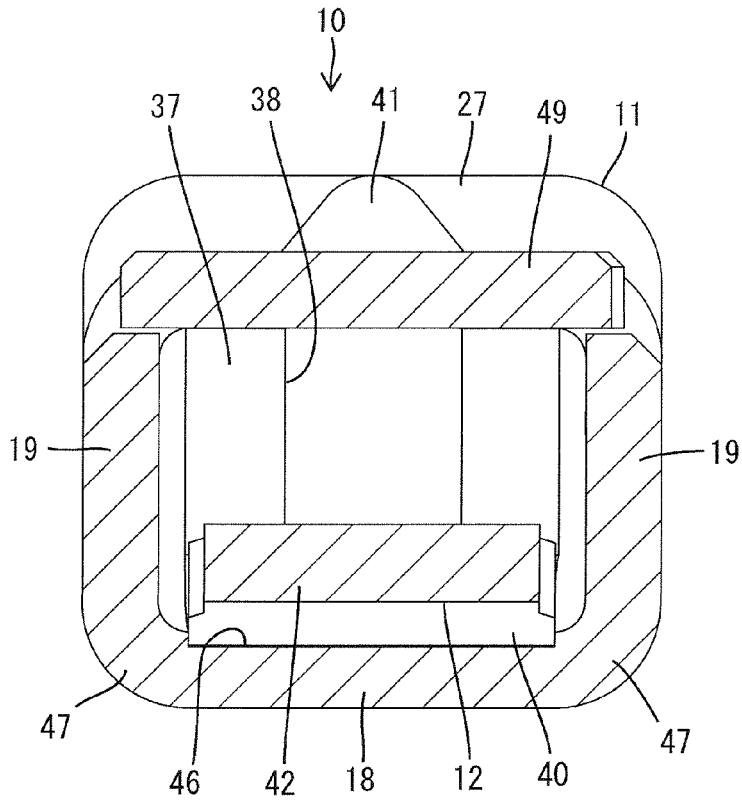
FIG. 6 is a section along A-A of FIG. 5.

As shown in FIGS. 4 and 5, the terminal fitting 10 includes a rectangular tubular main portion 11, a resiliently deformable contact piece 12 arranged in the main portion 11, and a wire connection portion 13 located behind and continuous with the main portion 11. The wire connection portion 13 includes a wire barrel 14 to be crimped, bent or folded into connection with a core exposed at an end of an unillustrated wire and an insulation barrel 15 to be crimped, bent or folded into connection with an insulation coating near the end portion the wire. The wire barrel 14 comprises two wire barrel pieces 16 to wrap around the core from substantially opposite sides in a width direction. The wire barrel pieces 16 are arranged at the same position in forward and backward directions. The insulation barrel 15 comprises two insulation barrel pieces 17 to wrap around the insulation coating from opposite sides in the width direction. The insulation barrel pieces 17 are displaced from each other in forward and backward directions.

Figure 3:
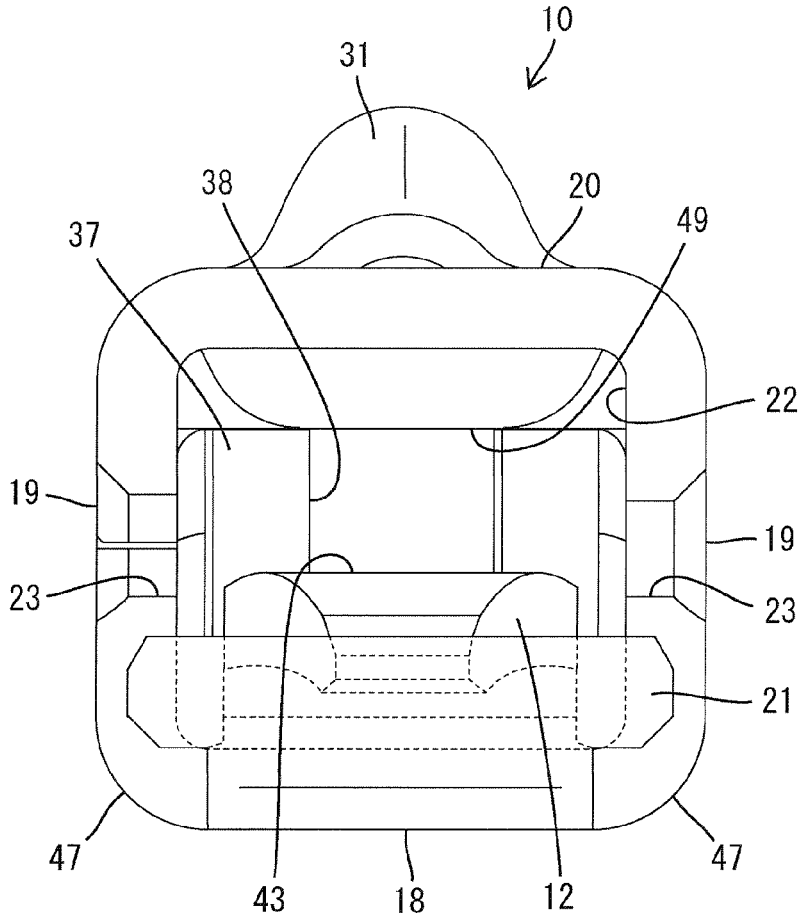
FIG. 3 is a front view of the terminal fitting.

As shown in FIG. 3, the main portion 11 comprises a base 18, two sides 19 projecting up from opposite widthwise sides of the base 18 and a ceiling 20 substantially facing the base 18. The base 18 extends substantially horizontally over the entire length of the terminal fitting 10 and is shared by the wire connection portion 13.

A closing portion 21 is formed at the front of the main portion 11 by bending a front end of the base 18 and a tab insertion opening 22 is formed above the closing portion 21 at the front of the main portion 11. A tab 61 can be inserted into the main portion 11 from the front through the tab insertion opening 22 and along an inserting direction ID. Cutouts 23 are formed at the front edges of the sides 19 and at the opposite sides of the terminal insertion opening 22 in the width direction.

Figure 7:
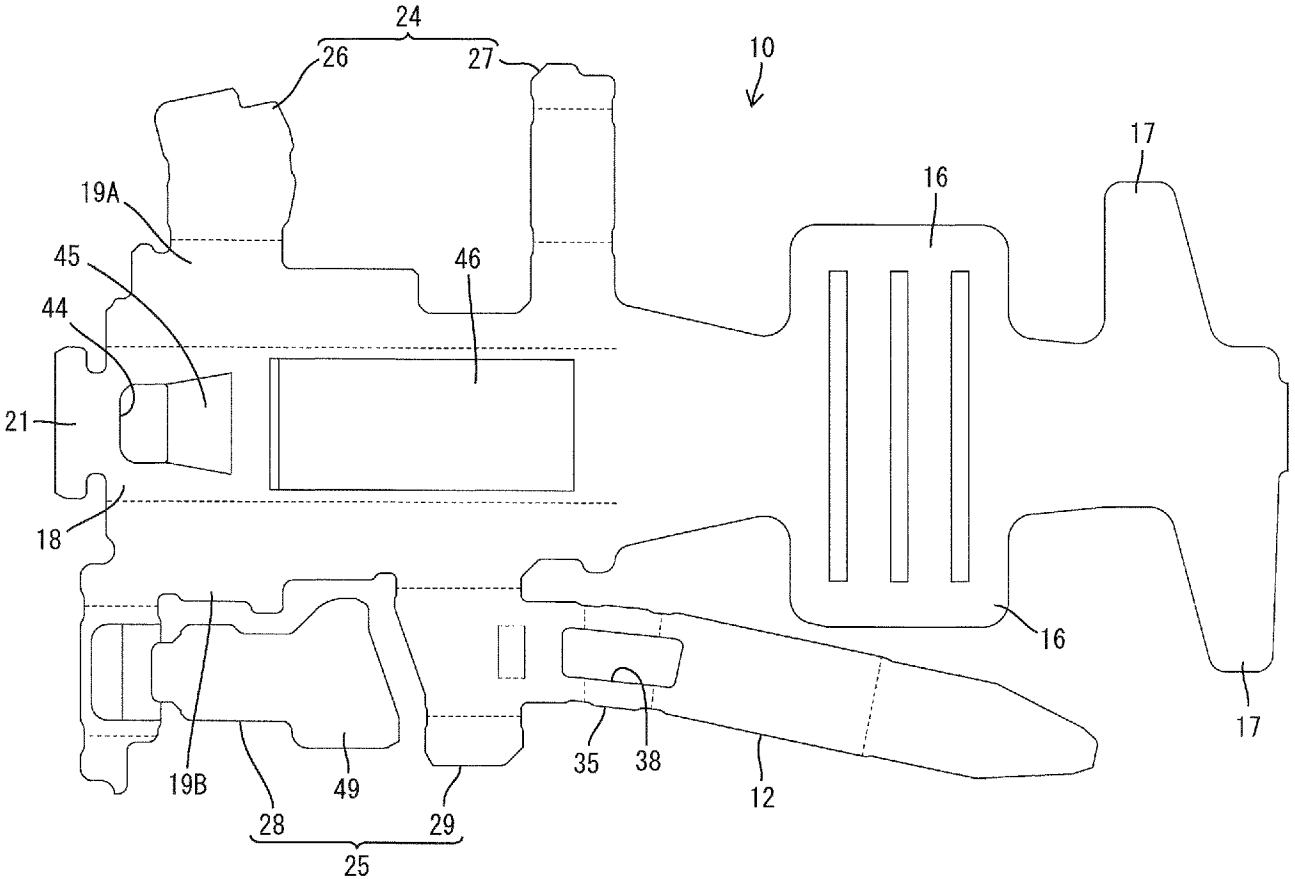
FIG. 7 is a development view of the terminal fitting.

As shown in FIG. 7, the ceiling 20 comprises a first ceiling plate 24 connected to a first side 19A and a second ceiling plate 25 connected to the second side 19B. The first ceiling plate 24 comprises a front first ceiling plate 26 located toward a front end and a rear first ceiling plate 27 located toward a rear end. The second ceiling plate 25 comprises a front second ceiling plate 28 located toward a front end and a rear second ceiling plate 29 located toward a rear end.

Figure 2:
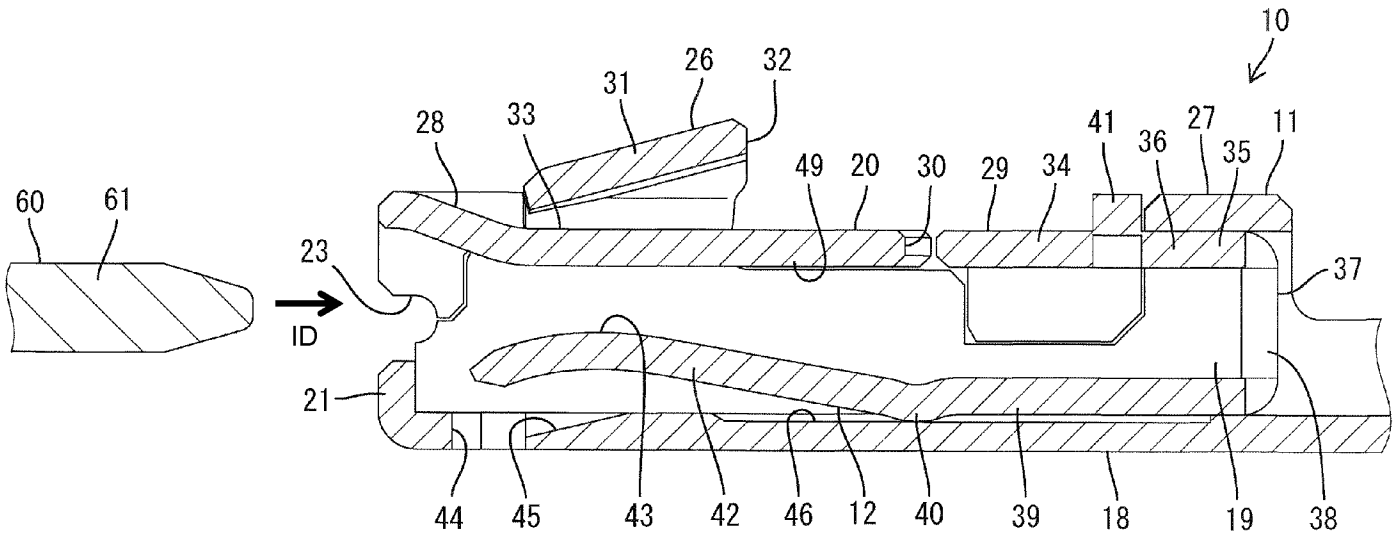
FIG. 2 is an enlarged section of an essential part showing a state before connection to the mating terminal fitting.

As shown in FIG. 2, the front and rear first ceiling plates 26, 27 are placed respectively on the upper surfaces of the front and rear second ceiling plates 28, 29. A slit 30 of a specified dimension is formed between the rear edge of the front second ceiling plate 28 and the front edge of the rear second ceiling plate 29, as shown in FIG. 4.

The front first ceiling plate 26 is shorter than the front second ceiling plate 28 in forward and backward directions. The front edge of the front first ceiling plate 26 is located behind the front edge of the front second ceiling plate 28, and the rear edge of the front first ceiling plate 26 is located before the rear edge of the front second ceiling plate 28.

The front first ceiling plate 26 is hammered or embossed up and out to form a locking projection 31. The locking projection 31 is inclined up and out toward the back from the front to the rear of the front first ceiling plate 26. The rear of the locking projection 31 defines a locking edge 32. A locking lance formed at an inner wall of a cavity of an unillustrated connector housing resiliently engages the locking edge 32 of the locking projection 31 when the terminal fitting 10 is inserted into the cavity, thereby retaining the terminal fitting 10 in the cavity.

The front second ceiling plate 28 is hammered, embossed or bent to project down and in to form a receiving portion 49 at a front end of the front second ceiling plate 28. The receiving portion 49 extends substantially horizontally along the inserting direction ID from this bent position to the rear edge of the front second ceiling plate 28. A recess 33 is formed on the upper surface of the front second ceiling plate 28 at a position substantially corresponding to the receiving portion 49. A front end portion of the locking projection 31 is to be inserted into this recess 33.

The rear first ceiling plate 27 is arranged at a rear end portion of the ceiling 20. The upper surface of the rear first ceiling plate 27 is at substantially the same height position as the upper surface of the front second ceiling plate 28.

The rear second ceiling plate 29 comprises a coupling 34 connected to the upper end of the second side 19B and an extending portion 35 connected to the rear edge of the coupling 34. The coupling 34 is arranged before the rear first ceiling plate 27. The rear edge of the coupling 34 and the front edge of the rear first ceiling plate 27 are in contact with each other. A projection 41 is formed by cutting and bending the coupling 34 at a position right before the rear first ceiling plate 27. The projection 41 is arranged to substantially face the locking projection 31. An insertion space for the locking lance is defined between the projection 41 and the locking projection 31.

The extending portion 35 comprises a backward extending portion 36 that extends back from the rear edge of the coupling 34 substantially along the lower surface of the rear second ceiling plate 29. A vertically or outward extending portion 37 is connected at a substantially right angle to hang down from the rear end of the backward extending portion 36, and the resilient contact piece 12 extends forward at a substantially right angle from the lower end of the vertical extending portion 37. The backward extending portion 36 is at the same height as the coupling 34 and the receiving portion 49. The vertical or outward extending portion 37 has a window hole 38. As shown in FIG. 3, parts of the vertical or outward extending portion 37 located at opposite sides of the window hole 38 in the width direction can be confirmed visually through the tab insertion opening 22 from front.

The resilient contact piece 12 is arranged along the base 18 in the main portion 11. More specifically, the resilient contact piece 12 comprises a straight portion 39 extending substantially horizontally forward from the lower end of the vertical extending portion 37, a support 40 at the front end of the straight portion 39 and a resilient main body 42 extending obliquely up and in (or intersecting the inserting direction ID) toward the front from the support 40 and then is inclined somewhat down toward the front at its front end. The resilient main body 42 is resiliently deformable vertically in a height direction with the support 40 as a supporting point.

A contact 43 is formed near the front end of the resilient main body 42. The contact 43 is at a highest or most projecting position in the resilient main body 42. A gap between the contact 43 and the receiving portion 49 is smaller than the thickness of the tab 61 when the resilient contact 12 is in a natural state. Thus, the tab 61 that has been inserted properly into the main portion 11 is sandwiched resiliently between the contact 43 and the receiving portion 49.

The support 40 is bent in a substantially downwardly convex U-shape between the front end of the straight portion 39 and the rear end of the resilient main body 42. In other words, the support 40 is bent slightly outward from the front end of the straight portion 39. The support 40 is formed over the entire width of the resilient contact piece 12. The entire straight portion 39 including its part connected to the support 40 is arranged substantially horizontally.

The base portion 18 of the main portion 11 has a through hole or recess 44 at a position substantially facing the free front end of the resilient main body 42. When the resilient contact piece 12 is deformed resiliently down due to contact with the tab 61, the front end of the resilient main body 42 enters the through hole or recess 44.

A retraction groove 45 is formed in the upper surface of the base 18 adjacent the through hole 44 and has a gradually increasing depth toward the through hole 44. The front end portion of the resilient main body 42 can enter the retraction groove 45 when the resilient contact piece 12 is deformed excessively.

A recess 46 is formed on the upper surface of the base 18 at a position facing the support 40. The recess 46 is formed within the thickness range of the base 18. More specifically, the recess 46 is rectangular in plan view and is formed in a range from a position substantially corresponding to an intermediate position behind the contact 43 of the resilient main body 42 to a position substantially corresponding to a rear end of the straight portion 39 in forward and backward directions and in a range over substantially over the entire width of the base 18 in the width direction, excluding chamfers 47 (see FIG. 6) at both sides 19.

The depth of the recess 46 is substantially equal to a projecting distance of the support 40. The support 40 is constantly in contact with the bottom surface of the recess 46 while being pre-loaded or biased. In this case, the support 40 is substantially in line contact with the bottom surface of the recess 46 along the width direction.

The resilient main body 42 and the straight portion 39 are separated from the bottom surface of the recess 46. The lower surface of the straight portion 39 and the bottom surface of the recess 46 are substantially parallel to each other. The straight portion 39 is in contact with the base 18 only at the rear end thereof. Further, the base 18 of the main portion 11 has a substantially constant thickness in forward and backward directions except at the recess 46, the through hole 44 and the retraction groove 45.

Figure 1:
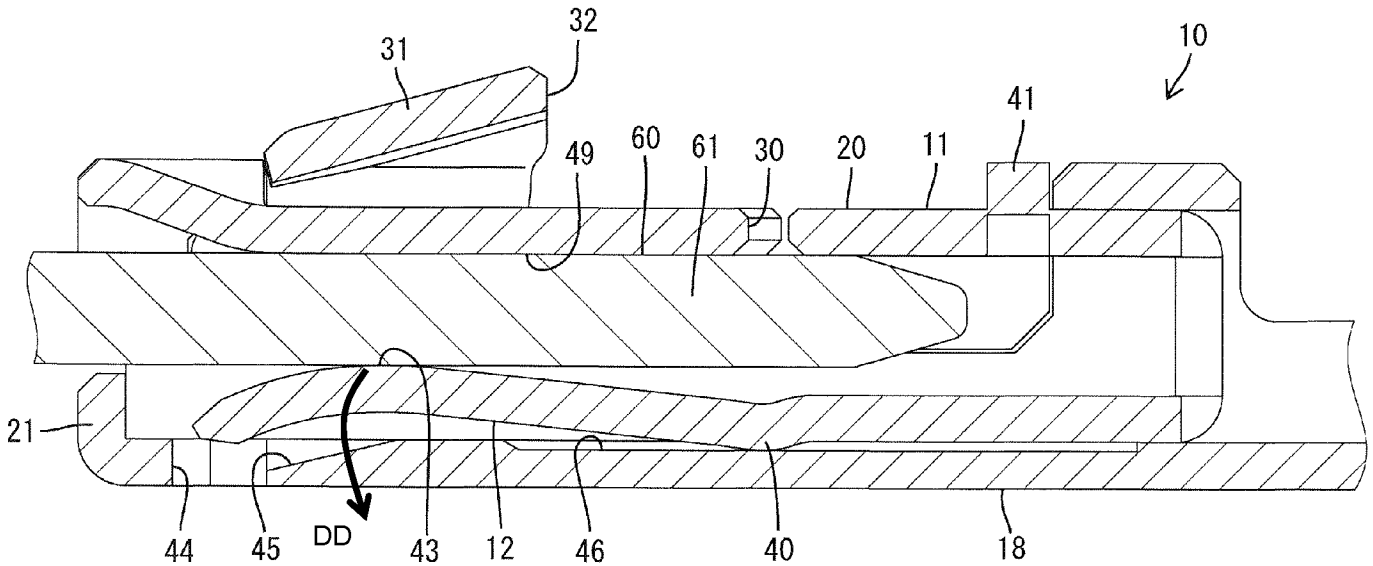
FIG. 1 is an enlarged section of an essential part showing a state where a terminal fitting according to the invention is connected to a mating terminal fitting.

The tab 61 is inserted along the inserting direction through the tab insertion opening 22 and into the main portion 11 as shown in FIG. 2. Thus, the tab 61 contacts the resilient contact piece 12 and deforms the resilient contact piece 12 out and down about the support 40 and in a deforming direction DD that intersects the inserting direction ID. The front end of the resilient main body 42 escapes into the through hole 44 when the tab 61 is inserted properly into the main portion 11, as shown in FIG. 1, thereby avoiding interference between the resilient contact piece 12 and the base 18. Further, a part of the resilient main body 42 near the support 40 slightly enters the recess 46 as the resilient main body 42 inclines. Thus, the two terminal fittings 10, 60 are connected electrically by resiliently sandwiching the tab 61 between the contact 43 and the receiving portion 49.

The recess 46 is formed on the upper or inner surface of the base 18 and the support 40 is in contact with the bottom surface of the recess 46. Thus, the height of the contact 43 from the upper surface of the base 18 can be lowered by the depth of the recess 46 as compared with the case where the recess 46 is not present on the upper surface of the base 18. Thus, the height of the main portion 11 can be smaller than the conventional main portion. As a result, miniaturization of the terminal fitting 10 can be realized while a deformation space for the resilient contact piece 12 is ensured.

Further, the support 40 is in contact with the bottom surface of the recess 46 while being pre-loaded. Thus, a contact state of the support 40 and the base 18 is firmly maintained.

Furthermore, the resilient contact piece 12 includes the straight portion 39 extending substantially straight from the rear end of the main portion 11 to the support 40 along the base 18. Thus, the straight portion 39 can be formed easily without bending this part. The straight portion 39 can be formed since the support 40 is accommodated in the recess 46 and not bent in a direction to be separated upward from the base 18 unlike the conventional supporting portion.

The invention is not limited to the above described and illustrated embodiment. For example, the following embodiments also are included in the scope of the invention.

The resilient contact piece may come into contact with the base portion to prevent an excessive resilient deformation thereof.

The formation range and shape of the recess are not limited to those of the illustrated embodiment.

A locking hole may penetrate the ceiling for receiving the locking lance.

What is claimed is:

1. A terminal fitting made of an electrically conductive plate material, comprising:

a tubular main portion having a front end configured for receiving a tab of a mating terminal fitting and a rear end spaced from the front end along a longitudinal direction, the main portion including a base extending along the longitudinal direction and a ceiling opposed to the base, a recess being formed within a thickness range of the base so that the base is thinner at the recess, the recess opening toward the ceiling and including a bottom surface facing toward the ceiling direction; and a resiliently deformable resilient contact piece arranged at least partly in the main portion and being connectable to the tab inserted into the main portion, the resilient contact piece including a support in contact with the bottom surface of the recess and supporting the support during resilient deformation.

2. The terminal fitting of claim 1, wherein the support is in contact with the bottom surface of the recess while being pre-loaded.

3. The terminal fitting of claim 2, wherein the resilient contact piece includes a straight portion extending substantially straight along the base from a back end of the main portion to the support.

4. The terminal fitting of claim 1, wherein the resilient contact piece comprises a straight portion extending substantially horizontally forward from a location on main portion, the support being connected to a front end of the straight portion and a resilient main body extending obliquely in toward the front from the support and inclined down toward the front at a front end portion.

5. The terminal fitting of claim 4, wherein the recess is formed in a range from a position substantially corresponding to an intermediate portion of the resilient main body to a position substantially corresponding to a rear end of the straight portion in forward and backward directions and in a range over substantially an entire width of the base of the main portion.

6. The terminal fitting of claim 4, wherein the base of the main portion is formed with a through hole or recess at a position substantially facing a free end of the resilient main body.

7. The terminal fitting of claim 6, further comprising a retraction groove formed in an inner surface of the base and communicating with the through hole, wherein a front end of the resilient main body can enter the retraction groove when the resilient contact piece is deformed excessively.

8. The terminal fitting of claim 7, wherein the retraction groove (45) gradually increases in depth toward the through hole(44).

9. The terminal fitting of claim 4, wherein the resilient main body and the straight portion are separated from the bottom surface of the recess.

10. A terminal fitting made of an electrically conductive plate material, comprising:

a main portion configured for receiving a tab of a mating terminal fitting, the main portion including a base and a recess being formed within a thickness range of the base, the recess including a bottom surface; and a resiliently deformable resilient contact piece arranged at the main portion and being connectable to the tab inserted into the main portion, the resilient contact piece including a support in contact with the bottom surface of the recess and supporting the support during resilient deformation, wherein a depth of the recess is substantially equal to a projecting distance of the support.

11. The terminal fitting of claim 1, wherein the ceiling includes a first ceiling plate connected to a first side of the main portion and a second ceiling plate connected to a second side of the main portion.

12. The terminal fitting of claim 11, wherein the first ceiling plate comprises a front first ceiling plate at a front end and a rear first ceiling plate at a rear end; and wherein the second ceiling plate comprises a front second ceiling plate at a front end and a rear second ceiling plate at a rear end.

13. The terminal fitting of claim 12, wherein the front second ceiling plate is bent to project in to form a receiving portion.

14. The terminal fitting of claim 12, wherein the rear second ceiling plate comprises a coupling connected to the second side and an extending portion connected to the rear edge of a ceiling plate, wherein the coupling is arranged before the rear first ceiling plate.

15. The terminal fitting of claim 14, wherein the coupling is formed with at least one projection right before the rear first ceiling plate.

16. A terminal fitting made of a unitary piece of an electrically conductive plate material, comprising:

a rectangular tubular main portion having opposite front and rear ends, a base extending from the front end to the rear end, opposed side walls extending up from opposite sides of the base, a ceiling opposed to the base and extending between the side walls, a recess formed in a surface of the base facing into the tubular main portion so that a thickness of the base at the recess is less than a thickness of the base at locations spaced from the recess, the recess including a bottom surface; and a resilient contact piece cantilevered forward in the main portion, the resilient contact piece including a convex support projecting into the recess and in contact with the bottom surface of the recess.

17. The terminal fitting of claim 16, wherein the resilient contact piece has a front end forward of the support and a contact with a convex surface facing the ceiling and disposed between the front end and the support.

18. The terminal fitting of claim 17, wherein the base of the main portion is formed with a hole at a position substantially facing the front end of the resilient contact piece.

19. The terminal fitting of claim 6, further comprising a sloped retraction groove on an inner surface of the base rearward of and adjacent the hole.

* * * * *